US010352334B2

(12) United States Patent
Amundson et al.

(10) Patent No.: US 10,352,334 B2
(45) Date of Patent: Jul. 16, 2019

(54) HYDRAULIC ACTUATOR SYSTEM

(71) Applicant: Ekso Bionics, Inc., Richmond, CA (US)

(72) Inventors: Kurt Reed Amundson, Berkeley, CA (US); Russdon Angold, American Canyon, CA (US); David Scheinman, San Francisco, CA (US); Tim Swift, Clovis, CA (US); Daniel P Norboe, Alameda, CA (US); Robert Moore, Union City, CA (US); Jonathan Beard, Berkeley, CA (US); Kyle Edelberg, Pasadena, CA (US)

(73) Assignee: Ekso Bionics, Inc., Richmond, CA (US)

( * ) Notice: Subject to any disclaimer, the term of this patent is extended or adjusted under 35 U.S.C. 154(b) by 1176 days.

(21) Appl. No.: 14/423,302

(22) PCT Filed: Aug. 27, 2013

(86) PCT No.: PCT/US2013/056832
§ 371 (c)(1),
(2) Date: Feb. 23, 2015

(87) PCT Pub. No.: WO2014/035984
PCT Pub. Date: Mar. 6, 2014

(65) Prior Publication Data

US 2015/0226234 A1 Aug. 13, 2015

Related U.S. Application Data

(60) Provisional application No. 61/693,463, filed on Aug. 27, 2012.

(51) Int. Cl.
*F15B 7/00* (2006.01)
*F15B 11/04* (2006.01)
(Continued)

(52) U.S. Cl.
CPC ..... *F15B 11/04* (2013.01); *A61H 1/024* (2013.01); *A61H 1/0244* (2013.01);
(Continued)

(58) Field of Classification Search
None
See application file for complete search history.

(56) References Cited

U.S. PATENT DOCUMENTS 5,282,460 A 2/1994 Boldt
6,205,780 B1 3/2001 Zervas
(Continued)

FOREIGN PATENT DOCUMENTS

DE 102010040755 3/2012
JP 2005076781 A * 3/2005 ..... E02F 9/2203
(Continued)

OTHER PUBLICATIONS

JP 2005076781 A machine translation from espacenet. 2005.*

*Primary Examiner* — Michael Leslie
*Assistant Examiner* — Michael Quandt
(74) *Attorney, Agent, or Firm* — Diederiks & Whitelaw, PLC

(57) ABSTRACT

The invention is directed to controlling a hydraulic actuation system having at least one degree of freedom, a prime mover, at least one actuation module and a controller, with each actuation module including: an over-center variable displacement pump having a power input connection configured to power the pump from the prime mover and a displacement varying input for varying the displacement of the pump; a displacement varying actuator configured to modulate the displacement varying input of the pump; an output actuator in direct communication with the pump, the output actuator configured to drive a corresponding degree of freedom; and at least one sensor establishing a feedback
(Continued)

measurement that represents a force or motion of the output actuator. Based on a value of each feedback measurement, the force or motion of the output actuator is regulated by controlling the prime mover and the displacement actuator for the output actuator.

25 Claims, 10 Drawing Sheets

(51) Int. Cl.

| | |
|---|---|
| ***A61H 3/00*** | (2006.01) |
| ***A61H 1/02*** | (2006.01) |
| ***F15B 11/028*** | (2006.01) |
| ***F15B 15/08*** | (2006.01) |
| *F04C 14/22* | (2006.01) |

(52) U.S. Cl.

CPC ..... *A61H 1/0262* (2013.01); *A61H 3/00* (2013.01); *F15B 7/006* (2013.01); *F15B 11/028* (2013.01); *F15B 15/08* (2013.01); *A61H 2201/1238* (2013.01); *A61H 2201/1246* (2013.01); *A61H 2201/1409* (2013.01); *A61H 2201/164* (2013.01); *A61H 2201/165* (2013.01); *A61H 2201/1614* (2013.01); *A61H 2201/1628* (2013.01); *A61H 2201/5061* (2013.01); *A61H 2201/5064* (2013.01); *A61H 2201/5069* (2013.01); *A61H 2201/5071* (2013.01); *A61H 2201/5079* (2013.01); *A61H 2201/5092* (2013.01); *F04C 14/22* (2013.01); *F15B 2211/205* (2013.01); *F15B 2211/20515* (2013.01); *F15B 2211/20546* (2013.01); *F15B 2211/20561* (2013.01); *F15B 2211/20576* (2013.01); *F15B 2211/27* (2013.01); *F15B 2211/6651* (2013.01); *F15B 2211/6652* (2013.01); *F15B 2211/6654* (2013.01); *F15B 2211/71* (2013.01)

(56) References Cited

U.S. PATENT DOCUMENTS

| | | | | |
|---|---|---|---|---|
| 6,502,393 | B1 * | 1/2003 | Stephenson ..... | F15B 11/006 60/414 |
| 6,725,581 | B2 * | 4/2004 | Naruse ..... | E02F 9/2217 37/348 |
| 6,962,220 | B2 | 11/2005 | Takenaka et al. | |
| 7,798,282 | B2 * | 9/2010 | Crossman ..... | B62D 5/065 180/417 |
| 7,883,546 | B2 | 2/2011 | Kazerooni et al. | |
| 7,942,833 | B2 | 5/2011 | Yasuhara | |
| 8,096,965 | B2 | 1/2012 | Gofer et al. | |
| 8,231,688 | B2 | 7/2012 | Fairbanks et al. | |

FOREIGN PATENT DOCUMENTS

| | | |
|---|---|---|
| JP | 2008057687 | 3/2008 |
| WO | WO 2005024246 | 3/2005 |
| WO | WO 2012/015087 | 2/2012 |

* cited by examiner

HYDRAULIC ACTUATOR SYSTEM

CROSS-REFERENCE TO RELATED APPLICATIONS

The present application represents a National Stage application of PCT/US2013/056832 entitled "Hydraulic Actuator System" filed Aug. 27, 2013, pending which claims the benefit of U.S. Provisional Application Ser. No. 61/693,463 entitled "Hydraulic Actuator System" filed Aug. 27, 2012.

STATEMENT REGARDING FEDERALLY SPONSORED RESEARCH OR DEVELOPMENT

This invention was made with U.S. government support under DARPA Contracts D11PC20084 and D12PC00250. The U.S. government has certain rights in the invention.

BACKGROUND OF THE INVENTION

The present invention relates to a high efficiency, low mass hydraulic actuation system for mobile robotics, and to mobile platforms in general, where the absence of AC mains requires particular attention to overall actuator system efficiency.

Significant effort has been spent attempting to adapt stationary, industrial hydraulic actuation systems to mobile needs, but these systems generally have poor efficiency, being tenable only when used with a combustion engine. The state of the art solution today is to use low efficiency hydraulic servo valves. While these valves have exceptional control performance, they have very low efficiencies and are therefore ill suited to battery powered systems. Even in applications where efficiency is not a requirement, better efficiency can lead to significant energy savings and reduced heat loading.

The state of the art in mobile robotic actuators is one of two varieties: (1) an electric motor coupled to each axis under control using a high ratio transmission such as a harmonic drive or ball screw; or (2) an electric motor driving a hydraulic pump in parallel with a hydraulic accumulator to create a constant pressure hydraulic supply rail and a hydraulic servo valve at each axis. Option (1) is the simpler solution but results in a high inertia at the axis because of the transmission, but this transmission is fundamental to the characteristics of electric motors and cannot be avoided until a conductor with a substantially lower resistance than copper can be used in electric motor design. Option (2) provides better performance, but at an efficiency (essentially because of the servo valves) that cannot be tolerated in a battery powered application. Although other actuators, such as electroactive polymers and pneumatic artificial muscles as well as other pneumatic or muscle like actuators, offer other solution paths, they have not yet reached a state where they can be used in intensive mobile applications. Major commercial endeavors and research platforms that are designed with commercial intent such as Honda's ASIMO, the Boston Dynamics BIG DOG, and iRobot's line of PACKBOTs, use either solution (1) or (2) above without exception.

SUMMARY OF THE INVENTION

The present system is concerned with employing an hydraulic actuator with a theoretical efficiency higher than that of an electric drivetrain. The actuation system is based around a miniature variable displacement hydraulic pump. Variable displacement pumps are well known in the art of hydraulics. Like a fixed displacement pump they convert rotary shaft motion into hydraulic fluid motion but, unlike a fixed displacement pump, a variable displacement pump has a rotary shaft input and an additional input that controls the displacement of the pump. Variable displacement pumps have been used in hydraulic systems to provide purely mechanical system control, often to maintain a constant pressure supply by connecting the mechanism varying the pump displacement to a spring opposing the system pressure. Some variable displacement pump are over-center variable displacement pumps, that is, the displacement may be decreased to zero—at which point the pump generates no flow—and continue past zero so that the direction of the hydraulic fluid flow may be reversed purely by varying the pump displacement. There are many classes of hydraulic pumps that can be designed to be over-center variable displacement hydraulic pumps, including radial piston pumps, axial piston pumps, and vane pumps.

The present invention uses a single variable displacement hydraulic pump to drive each axis under control. The power input shaft of each variable displacement pump is connected to a common rotary drive shaft, and each variable displacement pump has an individual electric motor controlling the displacement of that variable displacement pump. The common drive shaft is connected to one driving electric motor that acts as a prime mover. In a typical configuration of N axes, there would be one driving electric motor, and N actuation modules. Each actuation module would have one pump, one controlling motor, and one output actuator. The driving motor provides all the mechanical power for the system. Each controlling motor must provide only the power needed to overcome friction and the inertia of the part of the pump that must be moved in order to vary the displacement. Generally, either the system pressure does not work against the pump displacement mechanism, or the component of system pressure that does work against the pump displacement mechanism is very small, and therefore the controlling motors do not need to overcome the system pressure. The loads that must be overcome by the controlling motor in order to change the pump displacement may be quite small if the system is designed appropriately. With an optimized pump design, this actuation system can achieve the control bandwidth of a similar sized hydraulic servo valve system. The system can, of course, be run as a one-axis system, and this arrangement may be beneficial in specific applications, but many of its unique advantages scale favorably as the number of axes increases.

The invention has a number of advantages. Like a hydraulic system using servo valves, the weight at the axis is only the actuator, such as a hydraulic cylinder or hydraulic motor. However, the system is not controlled as by dissipating power in a valve but rather by varying the displacement of the pump to get the desired actuator output. By positioning the pump near zero displacement, the output actuator can be effectively used as a bidirectional controlled damper to slow or hold position regardless of the load on the axis. Furthermore, all loads applied to the actuators are reflected back through the variable displacement pumps onto a single drive shaft driven by a single motor. The common drive arrangement has four principle advantages:

1. 1. All energy used to move the output actuators is produced by a single prime mover. This is essential if the prime mover is a combustion engine. When the prime mover is an electric motor, a single electric motor will produce power more efficiently than several small electric motors.

2. The inertia of the prime mover and drive shaft help absorb peak loads. In a direct drive electrical system; additional inertia reduces actuation bandwidth, requiring smaller, less efficient motors.
3. Energy generated by an output actuator is transferred mechanically to the drive shaft and then directly to other output actuators without being converted to electrical energy. Thus regeneration is possible even when the prime mover cannot regenerate power, as in the case of an engine. If the net total of all output actuators produce more power than they absorb, and the prime mover can regenerate power, then electric power may be returned to the power supply.
4. The speed of the prime mover can vary while the controller continues to control the motion of the output actuators, provided the speed of the prime mover is sufficient to produce the required flow to each output actuator given the maximum displacement of the variable displacement pump associated with that actuator. Thus the speed of the prime mover is a free variable available for optimization by a high level process and the rate may be varied in order to maximize efficiency, minimize noise, provide a period of higher flow rates to allow for fast maneuvers, and/or save power during a period of inactivity.

There are a number of features of the invention that improve it's capabilities and efficiency, and these apply generally, regardless of the type of pump used in the invention. Additional object features and advantages of the invention will become more readily apparent from the following detailed description of preferred embodiments when taken in conjunction with the following drawings wherein like reference numerals refer to corresponding parts in several views.

DETAILED DESCRIPTION OF THE PREFERRED EMBODIMENTS

Described in detail below is a new approach to high efficiency hydraulic actuation that has broad application. In the description, for purposes of explanation, numerous specific details are set forth in order to provide a thorough understanding of the present invention. It will be obvious, however, to one skilled in the art that the present invention may be practiced without these specific details.

Figure 1:
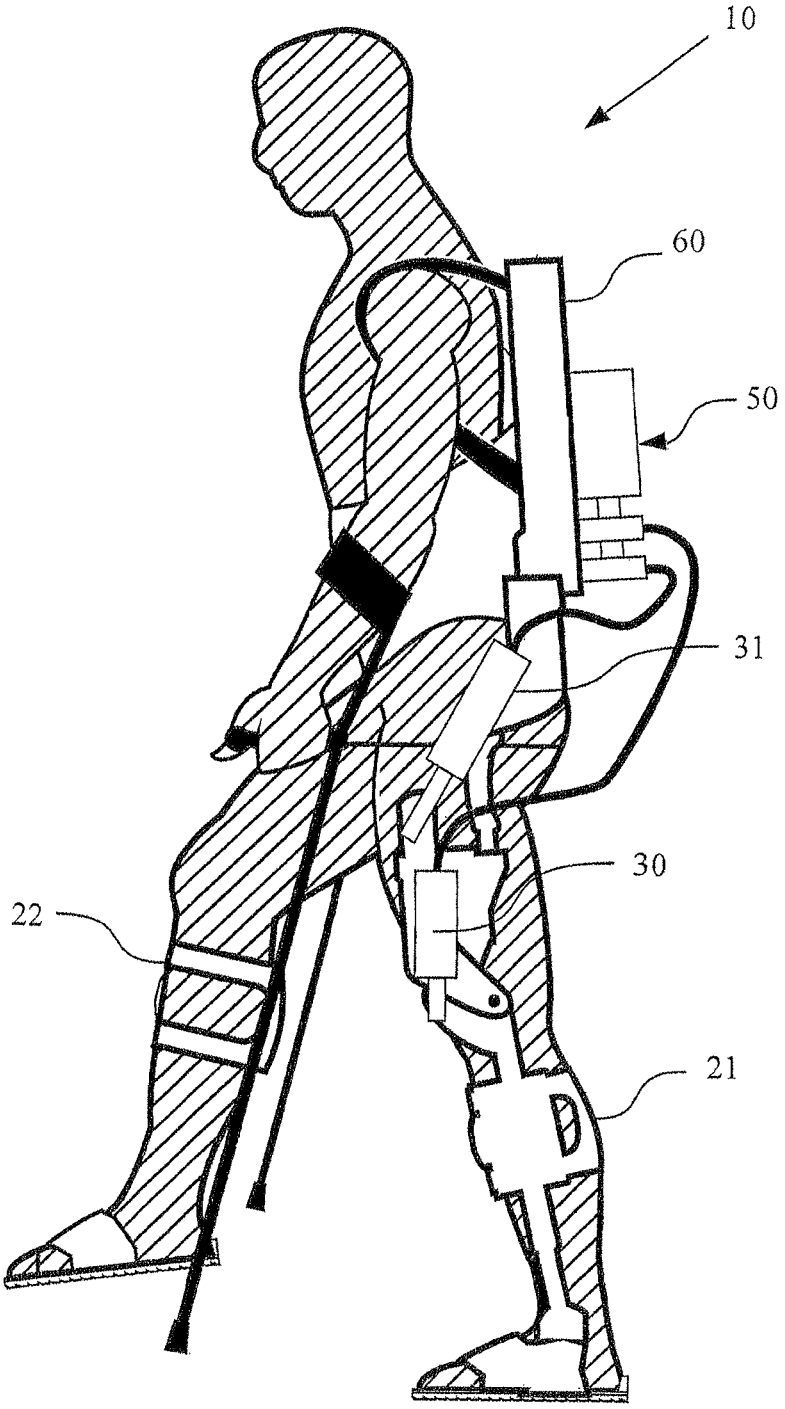
FIG. 1 is a view of an exoskeleton including an hydraulic actuator system according to the invention.

In the preferred embodiment, the actuation system can be used to control a mobile robotic exoskeleton. Exoskeletons can be used for various applications, such as aiding able bodied persons to carry extra weight and enabling paraplegics who have lost use of their lower limbs to walk. With reference to FIG. 1, an exoskeleton 10 has left and right legs 21 and 22, each leg having hydraulic cylinders 30 and 31 configured to respectively actuate the knee and hip of that leg. The four hydraulic cylinders are in communication with an actuation system 50 that forms part of a torso 60 of exoskeleton 10. Actuation system 50 is the primary object of this invention as actuation system 50 overcomes significant limitations of the known art.

Figure 2:
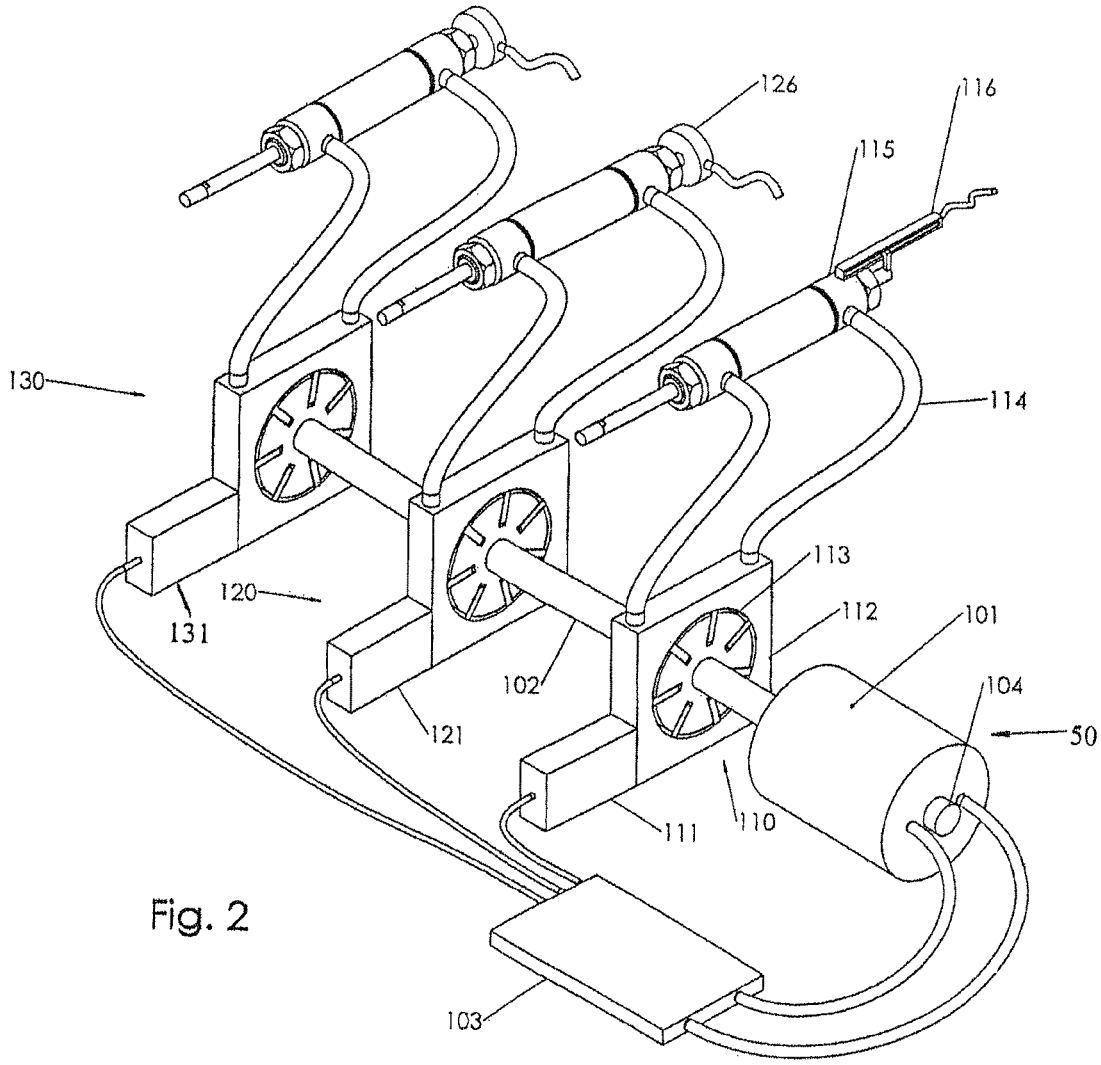
FIG. 2 is a view of the overall system including three actuation modules.

With reference to FIG. 2, in one exemplary embodiment, actuation system 50 is shown that is capable of powering three degrees of freedom. A prime mover, in this case an electric motor 101, rotates a drive shaft 102 based on signals from a controller 103. In practice, such an arrangement will require bearings, support structure, and an outer enclosure but, as these are not objects of the invention and are well understood in the art, they are not shown here. Three actuation modules, 110, 120, and 130, are shown coupled to drive shaft 102.

Each actuation module is preferably equivalent. In the embodiment shown, there are three actuation modules, but in some embodiments there may be one, two, four, or any number of actuation modules. The only practical limit to the number of actuation modules is the size and strength of drive shaft 102. Below is set forth a discussion of actuation module 110, but the discussion could apply just as well to any actuation modules. Actuation module 110 contains the following components: displacement actuator 111, pump housing 112, pump core 113, hydraulic lines 114, output actuator 115 (which could constitute a wide range of actuators, including hydraulic cylinders 30 and 31), and feedback sensor 116. The pump can be any type of hydraulic pump that allows over center operation. That is, operation where the displacement may be positive or negative so that the direction of flow from the pump may be reversed without changing the direction of input rotation but by instead changing the displacement. There are many types of pumps that can be designed to have over center capability, including vane and radial piston pumps. In general, any variable displacement pump with over center capability is effective and use of a specific design is not intended to limit the scope of the discussion.

Displacement actuator 111 varies the displacement of variable displacement pump by translating housing 112 (i.e., a displacement varying input). In some embodiments, displacement actuator 111 could rotate pump housing 112 to vary the pump displacement. In the preferred embodiment, displacement actuator 111 is an electric actuator, such as a voice coil motor. Displacement actuator 111 does not contribute substantial power to the motion of output actuator 115, instead displacement actuator 111 controls the motion of output actuator 115 by varying the displacement of variable displacement pump 117. It should be understood, however, that the forces applied by the displacement actuator necessarily include components related to the pressure generated by the pump. These forces are generally small, but can contribute substantially to overall power loss in the system because displacement actuator 111 must overcome them. These forces can be reduced by careful design of the pump, including specialized modifications to the pump which will be discussed later.

It is understood that a variable displacement pump is more complex than shown here, requiring outer housings, bearing arrangements, and porting, with these items not being shown here for clarity. Hydraulic lines 114 communicate the hydraulic working fluid from the pump to output actuator 115. Here output actuator 115 is shown as a linear hydraulic actuator, but could also be a rotary hydraulic actuator. The motion of output actuator 115 is monitored by feedback sensor 116. Feedback sensor 116 could indicate the position, the velocity, or both position and velocity of output actuator 115. There are many such sensors well understood in the art, including without restriction, potentiometers, encoders, and LVDTs. In some embodiments a force feedback sensor 126 might be used to monitor the force produced by the actuator. There are many such force sensors well understood in the art, including strain gauges, pressure sensors, and sensors utilizing piezoresistive materials. In some embodiments, not depicted here, an actuator might include feedback sensors capable of sensing both force and position. It should be understood that the feedback sensors 116 and 126 are in communication with controller 103, although the connection is not shown in FIG. 1.

Controller 103 controls the motion of electric motor 101, and displacement actuators 111, 121, and 131. Controller 103 may be a digital controller, such as a microcontroller or digital signal processor, or even an analog controller. In typical operation, controller 103 will maintain a relatively constant speed of drive shaft 102. In some embodiments, the prime mover may also have a speed sensor 104, to allow controller 103 to monitor and control the speed of electric motor 101 and dive shaft 102. Controller 103 further receives signals from feedback sensor 116, and force feedback sensor 126.

Again referring to actuation module 110, but equally applicable to each actuation module, controller 103 uses feedback control to move displacement actuator 111, thereby changing the displacement of the hydraulic pump and changing the flow to the corresponding output actuator 115. In the preferred embodiment, this is achieved with a PID controller, which is well understood in the art, but a more complex nonlinear control system could also be used. In general, the reference value to which controller 103 controls output actuator 115 is provided from a higher level control system that is not the object of this invention. The higher level control system could reside on controller 103 or on another controller that is in communication with controller 103, or even come from a human operator.

In some embodiments, the maximum displacement of each pump and the respective sizes of each output actuator may not be the same, but may be configured to match the requirements of each axis under the control of the actuation system. The ability to optimize the size of each actuation module for each individual axis enables a higher overall system efficiency.

Prime Mover Speed

Figure 3:
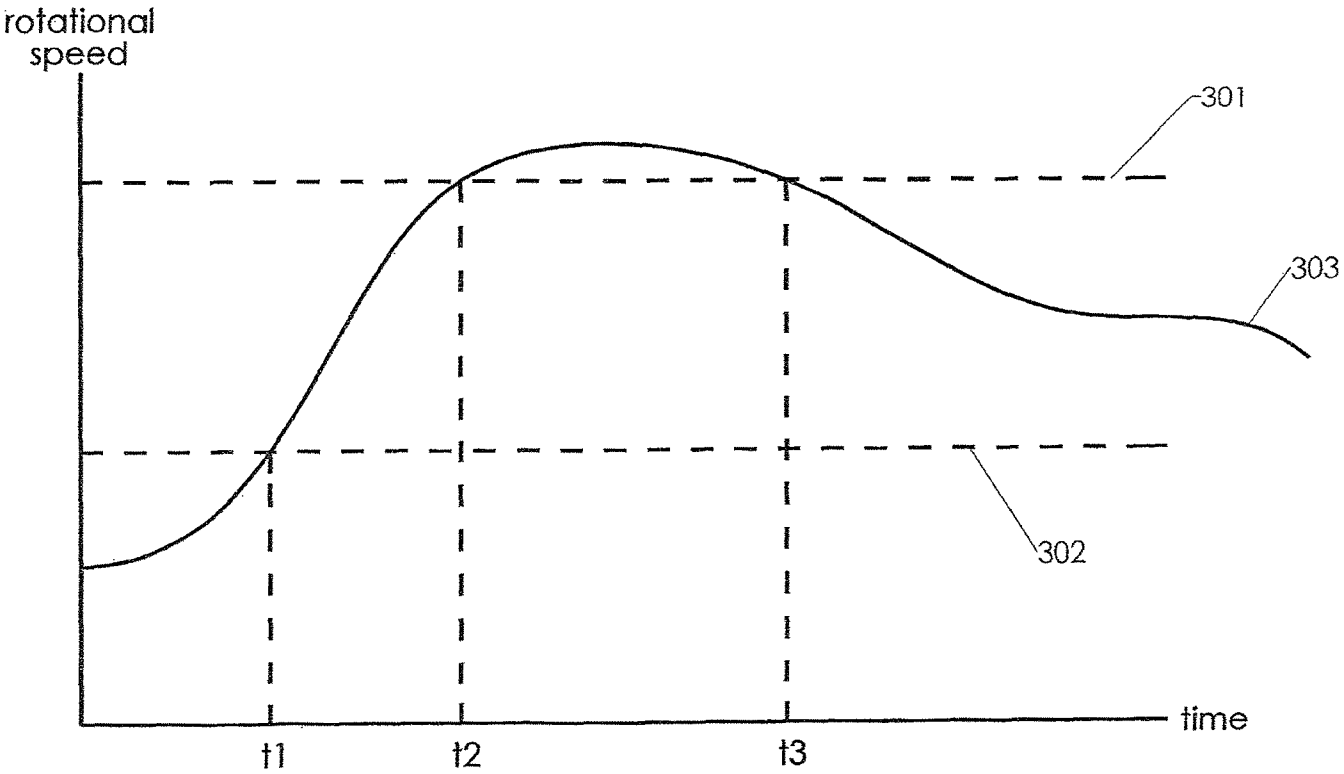
FIG. 3 is a plot of rotational speed over time that demonstrates how multiple rotation speeds for the prime mover may be used.
Figure 4:
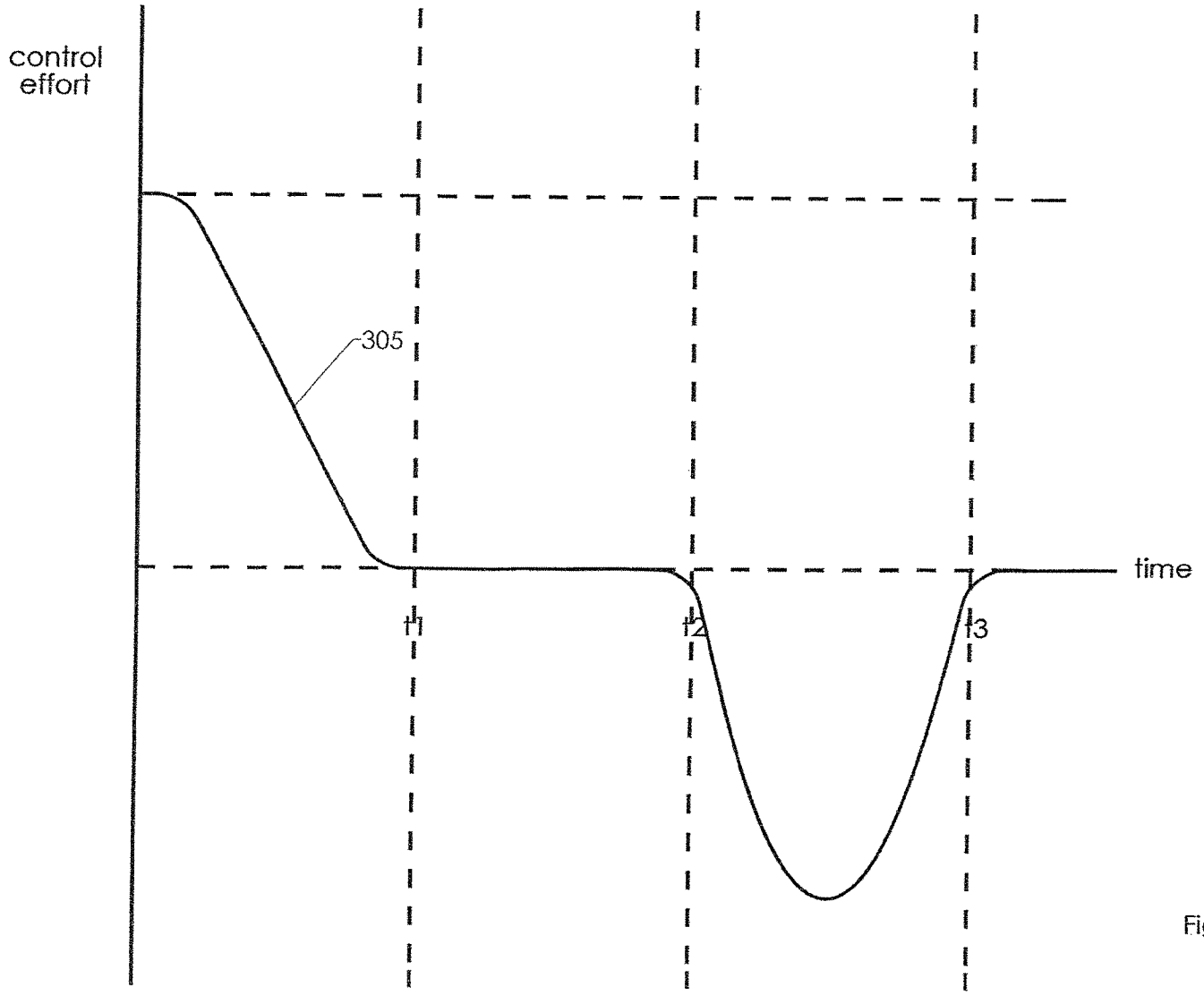
FIG. 4 is a plot of control effort applied by the controller to regulate the rotational speed shown in FIG. 3.

There are several embodiments for controlling the speed of the prime mover. In the first exemplary embodiment the controller 103 controls to several levels of rotational speed. FIG. 3 depicts a plot of rotational speed 303 over time, and FIG. 4 depicts the control effort expended by the controller to control the rotational speed 303 of the prime mover over the same time. Two speed levels are shown, i.e., low set point 302, and high set point 301. Before time t1, the controller exerts control effort 305 to maintain the speed of the prime mover generally close to low set point 302. Low set point 302 is chosen to maintain the required flow to each output actuator given the maximum displacement of the variable displacement pump associated with each corresponding actuator. Low set point 302 need not, in general, be a constant value, and could change based on the flow requirements of the output actuators. The controller behavior is depicted as being approximately a proportional control, but it should be understood that this is merely exemplary and many types of feedback control would be appropriate. At time t1, rotational speed 303 exceeds low set point 302, and the controller reduces control effort 305 to zero. Between times t1 and t2, control effort 305 remains zero. Because rotational speed 303 continues to increase during this time, the output actuators must be net absorbing power, although it is possible that any given output actuator could absorb power. At time t2, rotational speed 303 has exceeded high set point 301. That is, the actuation system has absorbed enough energy that the kinetic energy stored in its rotation has pushed rotational speed 303 to high set point 301. High set point 301 is chosen to be close to the maximum safe operating speed of the prime mover and drive shaft, a value dependent on the bearings chosen, the safe operating voltage of the controller, and other system design considerations. The controller applies negative control effort 305 to keep rotational speed 303 from climbing higher; during time t2 to t3, power is absorbed by the prime mover and returned to the electrical bus of the controller. This is often referred to as power regeneration as the prime mover acts as a generator, allowing the controller to return power to its corresponding power supply and extend system runtime if the power supply consists of batteries. However, more unique during this example of operation of the actuation system is that, during time t1 to t2, no power is required to drive the prime mover and power is transferred mechanically from one output actuator to another. This is as opposed to a conventional regeneration arrangement where transferring power from one axis to another requires converting energy from mechanical to electrical and then back to electrical, with the inefficiencies at each step in this process limiting its efficiency and therefore limiting its utility. Finally, at time t3, rotational speed 303 drops below high set point 301, and control effort 305 is reduced to zero.

It is important to note that the property elucidated in FIG. 4, that the rotational speed of the prime mover and associated drive shaft serves to store kinetic energy in a way that facilitates mechanical regeneration of power from one axis to another, has implications for the design of the actuation system as a whole. In general, it is desired for the prime mover and drive shaft to have as large a rotational inertia as feasible because this will serve to store more kinetic energy. As a result, the tendency in the design will be to make prime mover 101 as large as feasible, which will make the prime mover more efficient as larger motors are generally more efficient than smaller motors for a given non-reversing load. This is in contrast to a conventional electromechanical actuator where the inertia of the electric motor driving the actuator must be accelerated and decelerated and where the inertia therefore serves to reduce the actuator bandwidth. In these conventional actuators, the designer is driven to choose as small a motor as possible, to minimize inertia, which therefore also reduces actuation efficiency.

Figure 5:
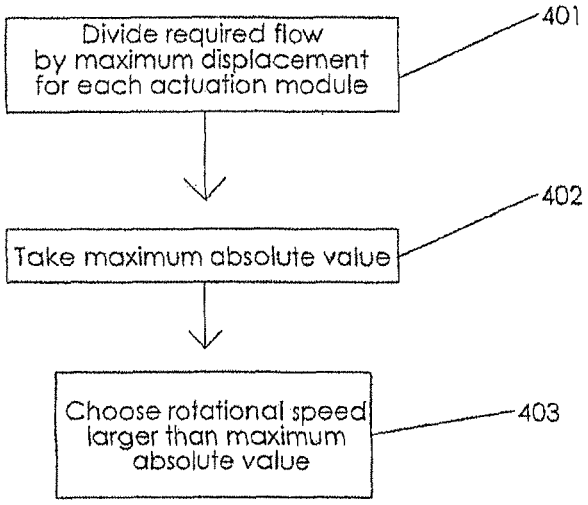
FIG. 5 is a flow chart that illustrates a simple heuristic for improving the performance of the system.

In another embodiment, which may be combined with the previous embodiment, the preferred speed of prime mover 101 is set according to three steps performed by controller 103, diagrammed in FIG. 5. In flow step 401, controller 103 divides the flow required at each output actuator by the maximum displacement of the pump corresponding to that output actuator. If the maximum displacement of the pump is unequal on the two sides of the pump, the controller must take account of the sign of the flow as well. In general, the controller may estimate this flow requirement by measuring or estimating the speed of the output actuator. In some embodiments, the controller may further use the acceleration of the output actuator or other outside information to improve this estimate. In other embodiments, where actuation system 50 is part of a device, the device may signal controller 103 about future flow requirements. In maximizing step 402, controller 103 computes the maximum of the flows for all actuation modules. In choosing step 403, controller 103 chooses a preferred speed that is slightly larger than this maximum value. How much larger the value must be depends on the application. When controller 103 operates at a higher sampling frequency, when prime mover 101 is generally overpowered with respect to the needs of the output actuators, and when the device using the actuation system does not produce rapid, dynamic motion, the preferred speed may be closer to the maximum value; when the reverse is true, the preferred speed may be required to be much larger. In some embodiments, it may be possible for controller 103 to change how much larger the proffered speed is than the maximum value based on how the device is operating.

Figure 6:
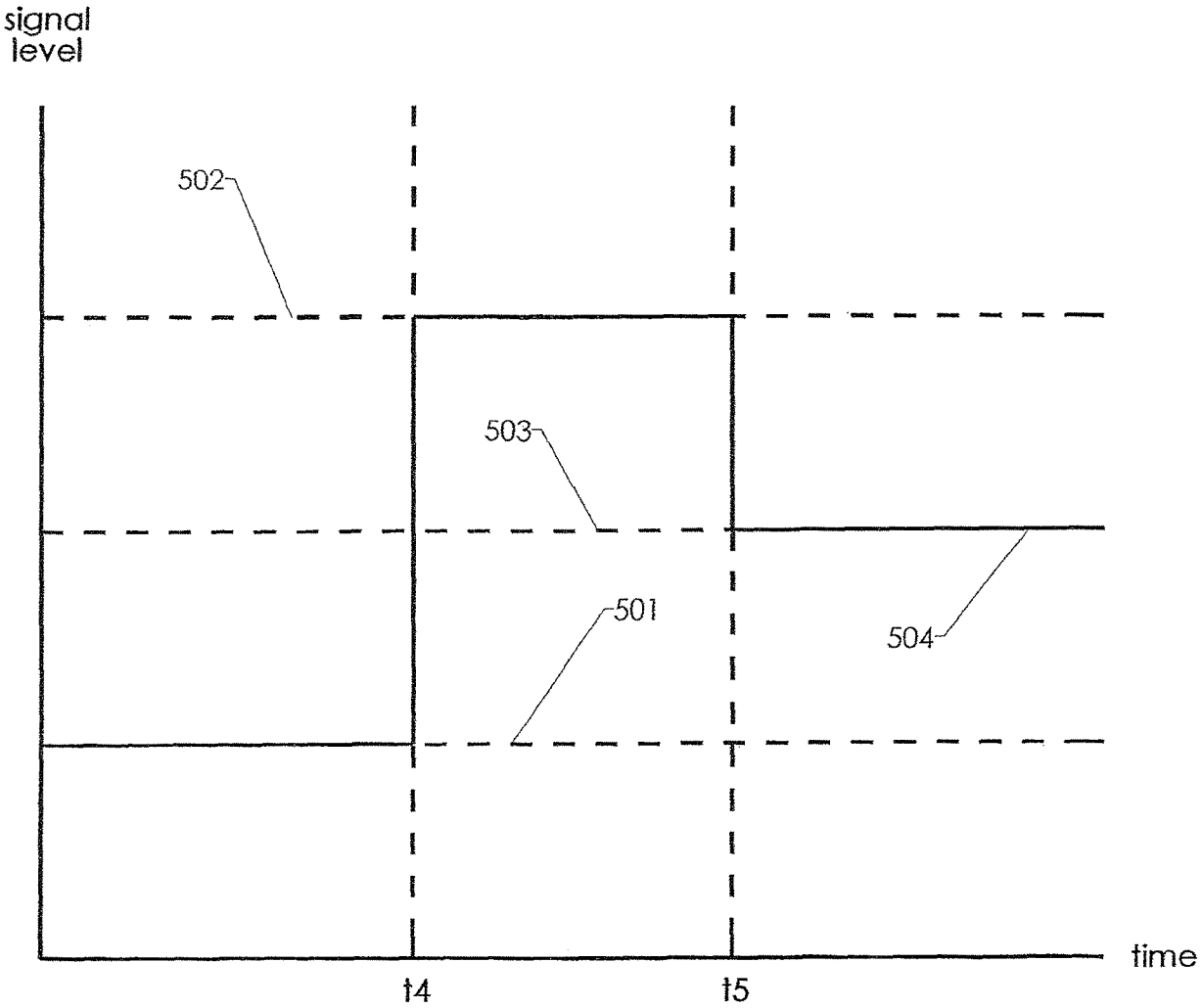
FIG. 6 is a plot of an external signal indicating to the actuation system in which of several modes it should operate.

In yet a further embodiment, actuation system 50 is part of an overall device, such as exoskeleton 10, and the device can signal actuation system 50. In some embodiments this signal might be a digital command, in others an analog signal, and in yet others, a mechanical motion. FIG. 6 depicts an embodiment of high level signal 504 over time. Before time t4, device signal 504 is at low level 501, indicating to controller 103 that the device is in a relatively non-dynamic situation, or in a situation where high efficiency is most important (e.g., when the device power source is low). As a result, controller 103 reduces the desired rotational speed of prime mover 101. At time t4, device signal 504 changes to high level 502, indicating that the device needs dynamic performance at the expense of lower efficiency. As a result, controller 103 increases the rotational speed of prime mover 101, putting more kinetic energy into the rotational speed 303 of the drive train and prime mover, but resulting in greater frictional losses. At time t3, device signal 504 changes to medium level 503, indicating that the device should operate at a normal level. As a result, controller 103 decreases the rotational speed of prime mover 101. At this point, it should be noted that there is no reason that device signal 504 need have three levels as in this example, but rather the resolution of device signal 504 will depend on the nature of the device using actuation system 50.

The embodiments discussed have assumed a simple model of power loss, namely that the efficiency of actuation system 50 monotonically decreases with the speed of prime mover 101 and drive shaft 102, that can be further refined. The efficiency of the systems depends on the efficiency of the variable displacement hydraulic pumps, and while most variable displacement hydraulic pumps achieve maximum efficiency when they operate near their maximum displacement, the behavior is complex and highly dependent on the geometry of the pump. However, controller 103, given an accurate model of the pump efficiency, and the efficiency of the other components, can optimize the prime mover speed in order to maximize the efficiency of actuation system 50. Methods for optimizing the performance of a system with one unconstrained degree of freedom, in this case prime mover speed, are well within the level of understanding in the art.

In another embodiment, efficiency may not be the most important metric for optimization of actuation system 50. In some embodiments, controller 103 may choose the speed of prime mover 101 to maximize the life of the pump. In other embodiments, controller 103 may minimize acoustic volume so that the device is less audible, maximize actuation performance so that the device has maximum bandwidth, or minimize the temperature of the hydraulic working fluid so that the device can cool down. In each embodiment, it is only necessary to build a model of the response of the parameter of interest to prime mover speed and use optimization techniques well understood in the art. Often, these models will be very simple. For instance, in the case of minimizing the acoustic noise of the system, it is merely necessary to characterize the noise produced by the system as a function of prime mover speed at various output actuator speeds and load. This could be done theoretically or experimentally. Then the controller could be instructed to avoid combinations of prime mover speeds, actuator speeds and loads that produce the most undesired noise. Finally, the device may signal controller 103 which of these parameters should be optimized during operation. In some embodiments, a human operator may be involved in deciding which parameter should be optimized. For example, the device might possess an "eco" button that, when pressed, indicates to controller 103 that it should optimize for high efficiency at the expense of performance.

Figure 7:
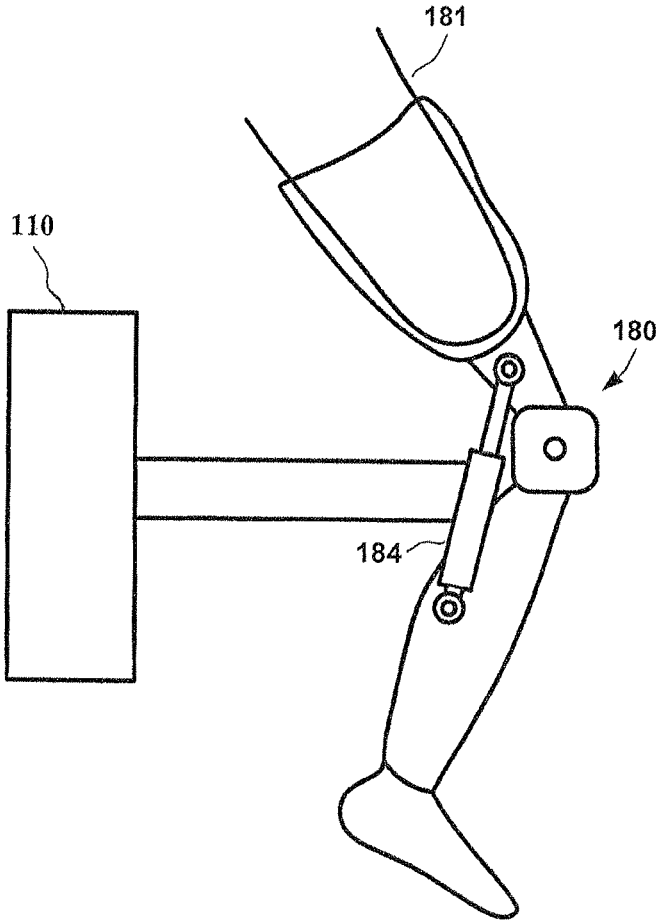
FIG. 7 is a schematic view of a prosthetic knee arrangement employing the actuator system of the invention.

In yet a further embodiment where actuation system 50 has only one actuation module 110, controller 103 has more latitude to optimize performance. In this special case, two degrees of freedom, i.e., prime mover 101 and displacement actuator 111, together control the motion of output actuator 115. Here, controller 103 can freely trade rotational speed of prime mover 101 and the displacement of variable displacement pump 117 without changing the performance of other actuation modules. This is particularly important in applications where there is one degree of freedom in a situation where regeneration is common. One such example is shown in FIG. 7 where actuation system 50 is included in transfemoral prosthetic 180 worn by person 181. Although the internal components of actuation system 50 are not shown in FIG. 7, it should be understood that actuation system 50 contains only one actuation module 110 with the corresponding output actuator 184 configured to control the flexion and extension of transfemoral prosthetic 180. During walking, the human knee will absorb mechanical power. However, most prosthetic devices cannot regenerate this absorbed power, even when the devices are powered, because the power level is too low to capture. Instead, prosthetic knees dissipate this power. Some embodiments, such as those illustrated in U.S. Pat. No. 8,231,688 and incorporated herein by reference, attempt to regenerate power with a fixed displacement pump, but cannot maximize their power regeneration and control the motion of the prosthetic at the same time because they can control only one input. However, by implementing an embodiment of actuation system 50 with only one actuation module 110, controller 103 can control displacement actuator 111 to maximize the efficiency of power regeneration to prime mover 101. In general, this requires maximizing the displacement of variable displacement hydraulic pump 117 so that the rotational speed of prime mover 101 is maximized. In some embodiments, controller 103 may seek to target the displacement of variable displacement pump 117 near its maximum value, but low enough that controller 103 may make quick adjustments to the motion of output actuator 115 (or 184) by changing the displacement while making gross adjustments to the motion of output actuator 115 by changing the speed of prime mover 101. There are many other optimization schemes that can be used here but, in general, the idea is to match the impedance of prime mover 101 to the load by varying the displacement of variable displacement pump 117. It is important to understand that this has broad application to any situation where energy is absorbed from the device in which actuation system 50 is implemented, and the rate at which that energy is absorbed is irregular. A partial list of applications, without limitation, includes powered vehicle suspensions, machines generating power from waves, and machines generating power from wind.

Actuation

There are many possible embodiments for displacement actuator 111 that are well known in the art, such as brushed, brushless, or stepper motors, or even electromagnets. For some configurations a transmission, e.g., gearbox, planetary gear, etc can be arranged between displacement actuator 111 and variable displacement pump 117 because the motor will not produce sufficient force. It is generally preferable for displacement actuator 111 and any accompanying transmission to be chosen such that the controlling motor may be moved by loads generated by variable displacement pump 117. This is often referred to as being "backdrivable." Making displacement actuator 111 and transmission backdrivable allows forces that are working in the direction of desired motion to help with that motion. Furthermore, such designs necessarily have low friction, leading to a higher efficiency. Because none of the power used by the displacement actuators contributes to work done by the output actuators, higher efficiency of the controlling motor will directly translate into higher system efficiency. Similarly, a more efficient displacement actuator will, for the same power, yield a higher bandwidth. Examples of preferred embodiments generally include a voice coil motor, brushless motor, toroidal motor, or any electrical actuator directly coupled to variable displacement pump 117, or coupled through a transmission that is backdrivable.

Figure 8:
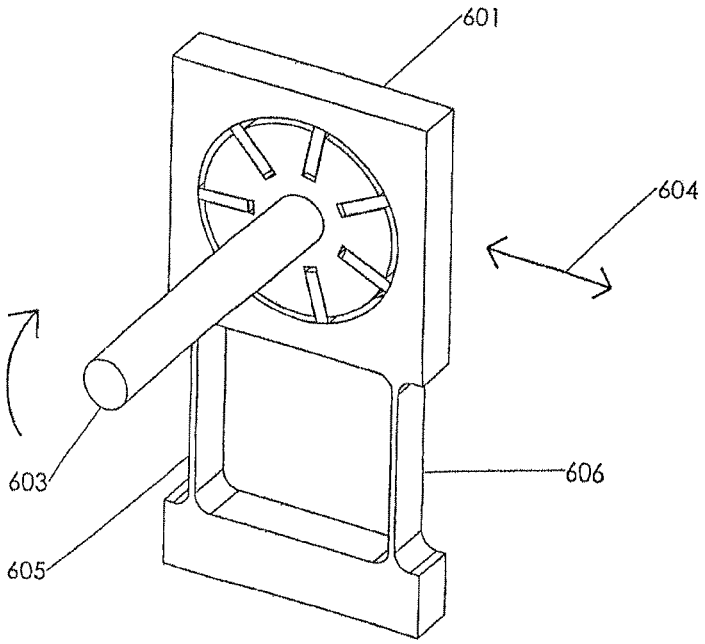
FIG. 8 is a view of a pump with a flexurally mounted housing, an arrangement with certain advantages for the invention.

In another embodiment, pump housing 112 is mounted to the actuation system (i.e., a stationary body) through a flexural element. FIG. 8 shows such an arrangement. Here, flexural pump housing 601 includes first and second flexural bars 605 and 606 respectively, that allow for small motions along deflection axis 604 but generally resist motion in other axes. The flexural elements must withstand the strain caused by the eccentricity of the pump. In some of these flexural embodiments, displacement actuator 111 could be a piezoelectric device. In some embodiments, it may be beneficial to sense the deflection of the flexures with a strain gauge.

In many of these embodiments it may be advantageous to submerge pump core 112 and pump housing 113 in the oil within an outer housing so that heat conduction is maximized and friction is minimized. In this embodiment, it is important that this oil is ported to the system reservoir so that motion of pump core 112 and pump housing 113 is not impeded.

Pump Loads

In some embodiments, unconventional designs may be used for variable displacement pump 117 in order to reduce loading on displacement actuator 111. Reducing loads on displacement actuator 111 directly improves the performance of actuation system 50 because power used by displacement actuator 111 is effectively lost.

In general, minimizing the mass of the pump that must be moved when displacement is changed, as well as minimizing the friction associated with changing displacement, will result in less power required by the controlling motor. But there are other loads reflected onto the controlling motors, and those will be discussed here.

Figure 9:
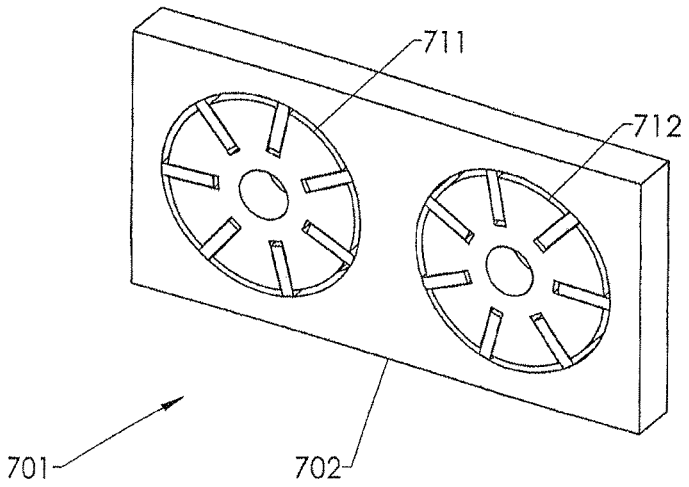
FIG. 9 is a view of a load balanced pump having one common housing.

As discussed above, it is possible, in some cases, that forces acting in the direction of motion of the controlling motors can be helpful; however, reducing the total load will improve the system efficiency. Load on the pump may occur because there is a slight asymmetry in the loading on most pumps. In some cases this loading may be static, it may vary in magnitude according to the relative pressures on the inlet and outlet of the pump, or it may vary as a function of the pump angular position due to pistons or vanes crossing the ports of the pump. In one embodiment, shown in FIG. 9, these loads may be partially canceled by building a pump 701 to have two pump cores 711 and 712 both within the same housing 702. In this embodiment, the flow outputs from the two pump cores are combined so that the loads on the two pumps are equal but opposite. This may be achieved by counter-rotating the pump cores, or by porting the pump cores 180 degrees out of phase and keeping their direction of rotation identical.

Figure 10:
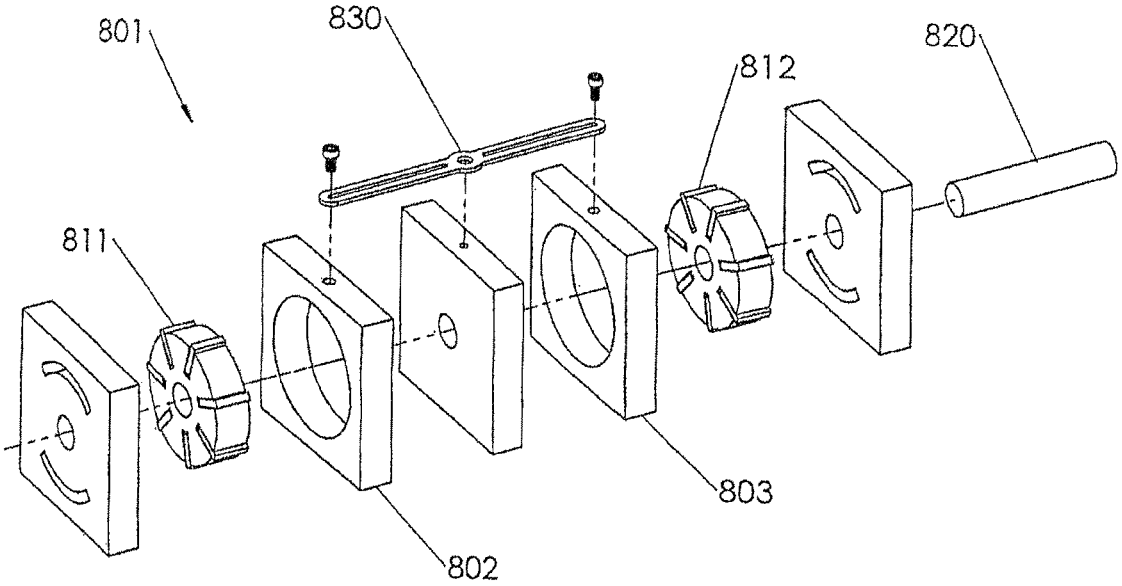
FIG. 10 is a view of a load balanced pump having two linked housings.

In another similar embodiment shown in FIG. 10, a pump 801 contains two pump cores 811 and 812 both coupled to the same drive shaft 820. Here the outlets of the two pump cores are combined as in the previous embodiment. However, unlike the previous embodiment, there are two housings, 802 and 803 respectively for pump cores 811 and 812. These housings have a mechanism 830 that moves them equal and opposite amounts when driven by the displacement actuator (not shown). While in the figure mechanism 830 is shown as a simple pinned lever, it should be understood that there are many simple mechanisms for generating such motion and mechanism 830 is intended only to illustrate but not restrict these possibilities. As a result of mechanism 830, the displacement of the two pump cores are changed in opposition, and asymmetric loads on the displacement actuator are neutralized. This embodiment has the advantage that only one drive shaft is required (where the embodiment of FIG. 9 would require two drive shafts), but requires mechanism 830, which adds complexity to the pump.

In either of these two embodiments, the losses associated with the pumps will increase, but this may be balanced by the designer against the losses associated with higher loads that must driven by the controlling motors if the pumps are not coupled. In some embodiments, it may be desirable to introduce a slight phase between each of the pumps connected to the driving shaft so that the peak torque required by each pump arrives out of phase with the others. This feature could reduce the peak load experienced by the drive shaft and allow the controller to more effectively control the speed of the drive shaft.

Although described with reference to preferred embodiments of the invention, it should be readily apparent that various changes and/or modifications could be made to the invention without departing from the spirit of the invention.

We claim:

1. A system for hydraulically actuating at least one degree of freedom, said system comprising:

a single prime mover for at least two actuation modules, wherein the prime mover produces rotary motion and is constituted by a battery powered electric motor, and each actuation module includes:

(1) an over-center variable displacement pump, said pump having:
(a) a power input connection configured to power the pump from said prime mover; and
(b) a displacement varying input for varying the displacement of the pump; and
(2) a displacement varying actuator configured to modulate the displacement varying input of the pump;
(3) an output actuator in direct communication with the pump, said output actuator being configured to drive an object through a corresponding degree of freedom, wherein the output actuator is in communication with each of a first and second side of the pump; and
(4) a feedback measurement that represents a force or motion of the output actuator, said feedback measurement being constructed from at least one sensor; and a controller configured to control the prime mover and the displacement varying actuator for each of said at least two actuation modules, wherein said controller further controls motion of the prime mover and uses the feedback measurement to regulate the force or motion of the output actuator by controlling the displacement varying actuator.

2. The system of claim 1 wherein said controller controls a speed of the rotary motion to maximize power transferred from said variable displacement pump wherein controlling the force or motion of the output actuator results in power being transferred from said variable displacement pump.

3. The system of claim 1 wherein the controller controls an angular speed of the prime mover to be constant.

4. The system of claim 1 wherein the output actuator has a limited travel.

5. The system of claim 1 wherein the controller controls the prime mover in three modes:
(1) producing power when an angular speed of the prime mover is below a low set point,
(2) producing no power when the angular speed of the prime mover is above said low set point but below a high set point, and
(3) absorbing power when the angular speed of the prime mover is above said high set point.

6. The system of claim 1 wherein the system is incorporated into a device, the controller controls a rotational speed of the prime mover and receives a signal from the device, and, based on the signal, the controller changes the rotational speed of the prime mover between at least two different values wherein lower values correspond to the device being in a rest state and higher values correspond to the device being in an active state.

7. The system of claim 1 wherein the controller controls the prime mover to a rotational speed, the controller includes a model of power loss in the actuation system, and said controller establishes the rotational speed to minimize power loss.

8. The system of claim 1 wherein the controller controls the prime mover to a rotational speed and said controller establishes the rotational speed to maximize a life of the pump.

9. The system of claim 1 wherein the controller controls the prime mover to a rotational speed and said controller establishes the rotational speed to minimize acoustic volume.

10. The system of claim 9 wherein the acoustic volume is minimized over a specific range of frequencies.

11. The system of claim 1 wherein the controller controls the prime mover to a rotational speed and the controller establishes the rotational speed to maximize performance in regulating the force or motion of the output actuator.

12. The system of claim 1 wherein the controller controls the prime mover to a rotational speed and the controller establishes the rotational speed to minimize an amount of power consumed in regulating the force or motion of the output actuator.

13. The system of claim 1 wherein the controller controls the prime mover to a rotational speed, the system is incorporated into a device, and said device signals said controller which of several modes of optimization the controller should use in order to choose the rotational speed of the prime mover, said modes including at least two of the following: minimizing power loss, maximizing efficiency, maximizing pump life, minimizing acoustic volume, maximizing actuation performance, and minimizing system temperatures.

14. The system of claim 13 wherein the device is configured to receive input from a human operator on which of said modes of optimization should be chosen.

15. The system of claim 1 wherein the displacement varying actuator is backdrivable.

16. The system of claim 1 wherein the variable displacement hydraulic pump includes a rotating core that holds pistons or vanes, a translating housing, and a stationary body, said rotating core being driven by said prime mover to rotate within said housing, said housing being translated by the displacement varying actuator, and said housing being constrained to translate with respect to the stationary body with a flexural connection.

17. The system of claim 1 wherein moving parts of said variable displacement pump are submersed in working hydraulic fluid.

18. The system of claim 1 wherein the variable displacement pump comprises two rotating cores that hold pistons or vanes, two translating housings, a housing connection, and a pump body, and wherein each said core is located coaxially along a common shaft and rotates within one of the two translating housings, and the housing connection couples said two translating housings so that the displacement varying actuator moves both translating housings in opposite directions.

19. A system for hydraulically actuating at least one degree of freedom, said system comprising:

a single prime mover for at least two actuation modules, wherein the prime mover produces rotary motion and is constituted by a battery powered electric motor, and each actuation module includes:
(1) an over-center variable displacement pump, said pump having:
(a) a power input connection configured to power the pump from said prime mover; and
(b) a displacement varying input for varying the displacement of the pump; and
(2) a displacement varying actuator configured to modulate the displacement varying input of the pump;
(3) an output actuator in direct communication with the pump, said output actuator being configured to drive an object through a corresponding degree of freedom; and
(4) a feedback measurement that represents a force or motion of the output actuator, said feedback measurement being constructed from at least one sensor; and a controller configured to control the prime mover and the displacement varying actuator for each of said at least two actuation modules, wherein said controller further controls motion of the prime mover and uses the feedback measurement to regulate the force or motion of the output actuator by controlling the displacement varying actuator, wherein the controller controls the prime mover to a rotational speed, and the controller chooses said rotational speed by:

(1) dividing the flow required by each said output actuator by a maximum displacement of a corresponding variable displacement pump of that output actuator, producing a required prime mover speed for that actuation module, (2) computing a maximum speed that is the maximum of an absolute value of each of the said required prime mover speeds, and (3) establishing said rotational speed to be slightly larger than said maximum speed.

20. The system of claim 19 wherein the system is incorporated in a device, with the device estimating future flow requirements and signaling the future flow requirements to the controller, said controller utilizing the future flow requirements in place of a flow presently required by the output actuator.

21. A system for hydraulically actuating at least one degree of freedom, said system comprising:

a single prime mover for at least two actuation modules, wherein the prime mover produces rotary motion and is constituted by a battery powered electric motor, and each actuation module includes:

(1) an over-center variable displacement pump, said pump having:

(a) a power input connection configured to power the pump from said prime mover; and (b) a displacement varying input for varying the displacement of the pump; and (2) a displacement varying actuator configured to modulate the displacement varying input of the pump;

(3) an output actuator in direct communication with the pump, said output actuator being configured to drive an object through a corresponding degree of freedom; and (4) a feedback measurement that represents a force or motion of the output actuator, said feedback measurement being constructed from at least one sensor; and a controller configured to control the prime mover and the displacement varying actuator for each of said at least two actuation modules, wherein said controller further controls motion of the prime mover and uses the feedback measurement to regulate the force or motion of the output actuator by controlling the displacement varying actuator, wherein the variable displacement pump comprises two rotating cores that hold pistons or vanes, and a translating housing.

22. The system of claim 21 wherein said two rotating cores are rotatably coupled to said prime mover to rotate in opposite directions within said translating housing, and hydraulic fluid is ported to and from the two rotating cores in phase, whereby forces from the two rotating cores onto the translating housing are neutralized.

23. The system of claim 21 wherein said two rotating cores are rotatably coupled to said prime mover to rotate in the same direction within said translating housing, and hydraulic fluid is ported to and from the two rotating cores out of phase, whereby forces from the two rotating cores onto the translating housing are neutralized.

24. A method for controlling a hydraulic actuation system having at least one degree of freedom, a single prime mover for at least two actuation modules, wherein the prime mover produces rotary motion and is constituted by a battery powered electric motor, and a controller for controlling motion of the prime mover, with each actuation module including: an over-center variable displacement pump having a power input connection configured to power the pump from said prime mover and a displacement varying input for varying the displacement of the pump; a displacement varying actuator configured to modulate the displacement varying input of the pump; an output actuator in direct communication with the pump, said output actuator configured to drive an object through a corresponding degree of freedom, wherein the output actuator is in communication with each of a first and second side of the pump; and at least one sensor establishing a feedback measurement that represents a force or motion of the output actuator, said method comprising:

reading a value of each feedback measurement; and controlling the force or motion of the output actuator using the feedback measurement by controlling the prime mover and the displacement actuator for the output actuator of a respective one of said at least two actuation modules.

25. A system for hydraulically actuating one degree of freedom within a device, said system comprising:

a prime mover and one actuation module, said module including:

(1) an over-center variable displacement pump, said pump having:

(a) a power input connection configured to power the pump from said prime mover, (b) a displacement varying input for varying a displacement of the pump, (2) a displacement varying actuator configured to modulate the displacement varying input of the pump, (3) an output actuator in direct communication with the pump, said output actuator configured to drive an object through a corresponding degree of freedom, wherein the output actuator is in communication with each of a first and second side of the pump, and (4) at least one sensor for constructing a feedback measurement that represents a force or motion of the output actuator, and a controller configured to control the prime mover and the displacement varying actuator wherein, when said output actuator is absorbing power from said device, said controller controls the prime mover and displacement varying actuator to:

(1) regulate the force or motion of said output actuator, and (2) maximize power absorbed by said prime mover.

* * * * *